US006726470B1

(12) United States Patent
Meister

(10) Patent No.: US 6,726,470 B1
(45) Date of Patent: Apr. 27, 2004

(54) DISPOSABLE LIQUID FUEL CELLS FOR WINDPROOF LIGHTERS

(75) Inventor: Ronald J. Meister, Bradford, PA (US)

(73) Assignee: Zippo Manufacturing Company, Bradford, PA (US)

( * ) Notice: Subject to any disclaimer, the term of this patent is extended or adjusted under 35 U.S.C. 154(b) by 0 days.

(21) Appl. No.: 10/315,868

(22) Filed: Dec. 10, 2002

(51) Int. Cl.[7] ..... F23D 11/36

(52) U.S. Cl. ..... 431/154; 431/143; 431/323; 431/130

(58) Field of Search ..... 431/130, 143, 431/133, 255, 136, 323, 324, 320, 153, 154

(56) References Cited

U.S. PATENT DOCUMENTS 2,032,695 A 3/1936 Gimera et al.
2,441,242 A * 5/1948 Harkins ..... 431/154
2,517,191 A 8/1950 Flickinger et al.
2,692,492 A * 10/1954 Hepburn ..... 431/143
2,957,328 A * 10/1960 Gellman ..... 431/130

FOREIGN PATENT DOCUMENTS

DE 2557115 * 6/1976 ..... 431/255

* cited by examiner

*Primary Examiner*—James C. Yeung
(74) *Attorney, Agent, or Firm*—Hodgson Russ LLP

(57) ABSTRACT

A windproof lighter is provided having an inside unit and an exterior case. The inside unit has an interior chamber, a wick, a flint, a flint position apparatus positioned in the interior chamber, a flint wheel, and a chimney. The lighter has a disposable fuel cell containing lighter fuel. The fuel cell is designed to fit within the interior chamber and to not interfere with the flint position apparatus. When the container is to be used in a windproof lighter, it has an opening that receives the wick. The wick extends into the interior chamber and has a component that is larger than the opening so that when the container is properly positioned within the interior chamber, the component secures the container in position and prevents accidental spillage of the lighter fuel.

16 Claims, 4 Drawing Sheets

(PRIOR ART)

DISPOSABLE LIQUID FUEL CELLS FOR WINDPROOF LIGHTERS

FIELD OF THE INVENTION

The present invention relates to a windproof lighter, and specifically to the type including liquid fuel, a wick, a strike-wheel, and a flint.

BACKGROUND OF THE INVENTION

Windproof lighters are disclosed in U.S. Pat. No. 2,517,191 to Flickinger et al. and U.S. Pat. No. 2,032,695 to Gimera et al., which are incorporated by reference in this application.

A windproof lighter 10, as shown in FIG. 1, has a case 12 and an inside unit 14. The case 12 has a top section 16 and a bottom section 18 connected together by a hinge 20. The inside unit 14 is removably secured, preferably snugly fit, within the bottom section 18.

Turning to FIG. 2, the inside unit 14 has an interior chamber 36 and an exterior surface 38. On the exterior surface 38 and the side 39 that projects beyond the bottom section 18 when the inside unit 14 is within the bottom section 18, is, as shown at FIGS. 2 and 4, a chimney 22, a wick opening 23 within the chimney 22, a wick 25, a flint wheel 24 connected to the chimney 22, a flint 26 designed to be positioned below and contacting the flint wheel 24, a tang 30 connected to the chimney 22, and a second resilient member 32 for controlling the position of the tang 30, which assists in the positioning of the top section 16.

The exterior surface 38 also has side walls 35 that contact corresponding side walls of the bottom section 18, and an opening 37 that is positioned opposite;the chimney 22 and allows a user to refill the lighter 10 with lighter fuel, not shown. The interior chamber 36 has a flint position apparatus 28 having a resilient member 42 contained within a tube 40 and a set screw 44. The set screw 44 allows the user to apply sufficient force through the resilient member 42 to the flint 26 so the flint 26 contacts the flint wheel 24.

The interior chamber also has packing material 60 that is designed to contain lighter fuel, and a felt pad 62 positioned at the opening 37, as shown in FIG. 3, between the packing material 60 and the bottom section 18. The felt pad 62 is secured into position by the set screw 44.

The interior chamber also has a wick 25 positioned within the packing material 60, and extending through the wick opening 23.

Windproof lighter 10 operates with lighter fuel and is refillable. The instructions for refilling lighters typically call for (1) removing the inside unit from the case; (2) lifting the corner of the felt pad on the bottom of the insert to reveal the packing material in a fuel chamber, which is the interior of the inside unit; and (3) saturating the packing with lighter fluid by filling it slowly so the inside unit is not overfilled; and (4) inserting the inside unit back into the case; and (5) wiping the lighter and the user's hands dry before igniting the lighter.

Some lighters have permanent inside units with refill ports on the bottom or on the side of the lighter for refilling the liquid fuel reservoir in the inside unit. These designs have special refilling instructions as well.

Accordingly, there is a need for an easy and reliable way to refill windproof lighters.

SUMMARY OF THE INVENTION

The present invention meets the above-described need by providing a disposable liquid fuel cell. The fuel cell is designed to fit within the interior chamber and to not interfere with the flint position apparatus, and the fuel cell has an opening that receives the wick. The wick extends into the interior chamber and has a component that is larger than the opening so that when the fuel cell is properly positioned within the interior chamber, the component secures the fuel cell in position and prevents accidental spillage of the lighter fuel.

DETAILED DESCRIPTION OF THE INVENTION

Figure 1:
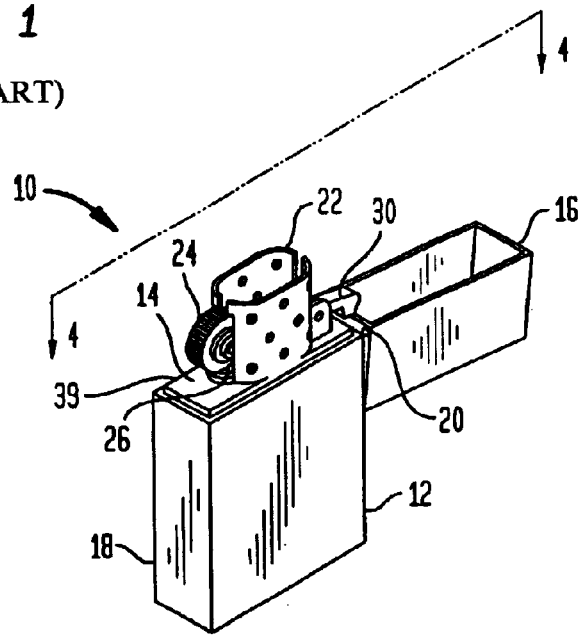
FIG. 1 (PRIOR ART)
FIG. 1 illustrates a prior art windproof lighter.
Figure 2:
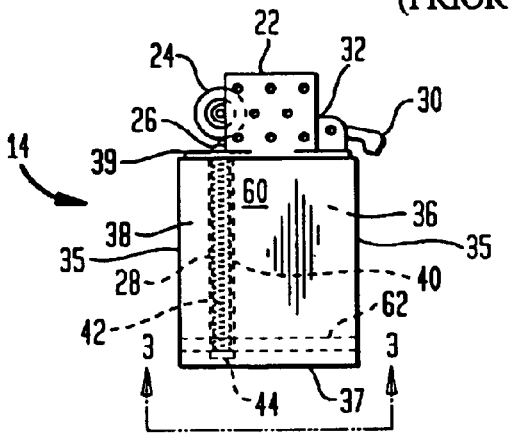
FIG. 2 (PRIOR ART)
FIG. 2 illustrates a prior art inside unit of a lighter.
Figure 3:
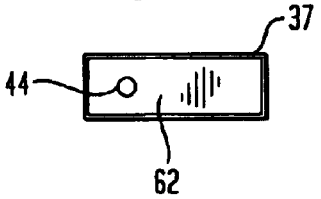
FIG. 3 is a view of FIG. 2 taken along the lines of 3—3.
Figure 4:
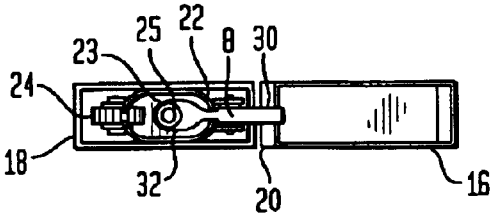
(PRIOR ART) FIG. 4
FIG. 4 is a view of FIG. 1 taken along the lines of 4—4.
Figure 5:
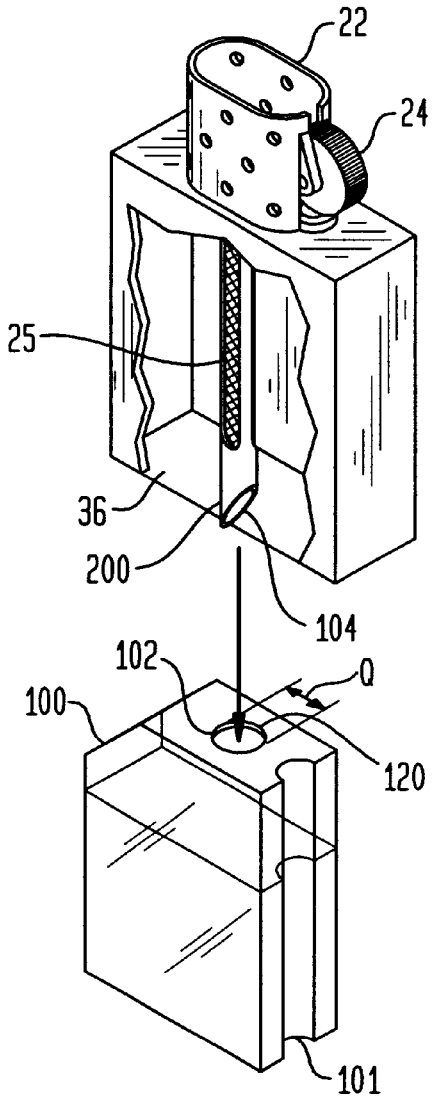
FIG. 5 is an exploded view of the present invention.

Referring to FIGS. 5–9, the cell 100, as shown in FIG. 5, is molded from a plastic material, preferably transparent or translucent material so the fuel volume can be seen, and has perimeter shape that fits, preferably snugly, within the interior chamber 36 and has a space 101 for the first resilient member 28, and a user's fingers to pull the cell 100 out of the inside unit 14. The cell 100 replaces the packing material and the felt pad of the prior art design.

In one embodiment, the cell 100 has a rupture disc 102 having a rim 120 which has an opening size of Q. The rupture disc 102 is positioned to be punctured by a rigid wick tube 104, which extends below the wick opening 23 and has a splash cut or equivalent ending 200 that can penetrate the rupture disc 102 with the user's applied force to both the cell 100 and the inside unit 14.

Figure 6:
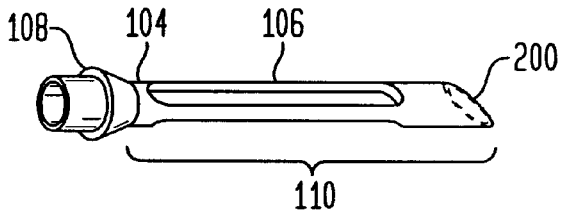
FIG. 6 is a view of the wick tube of FIG. 5.
Figure 7:
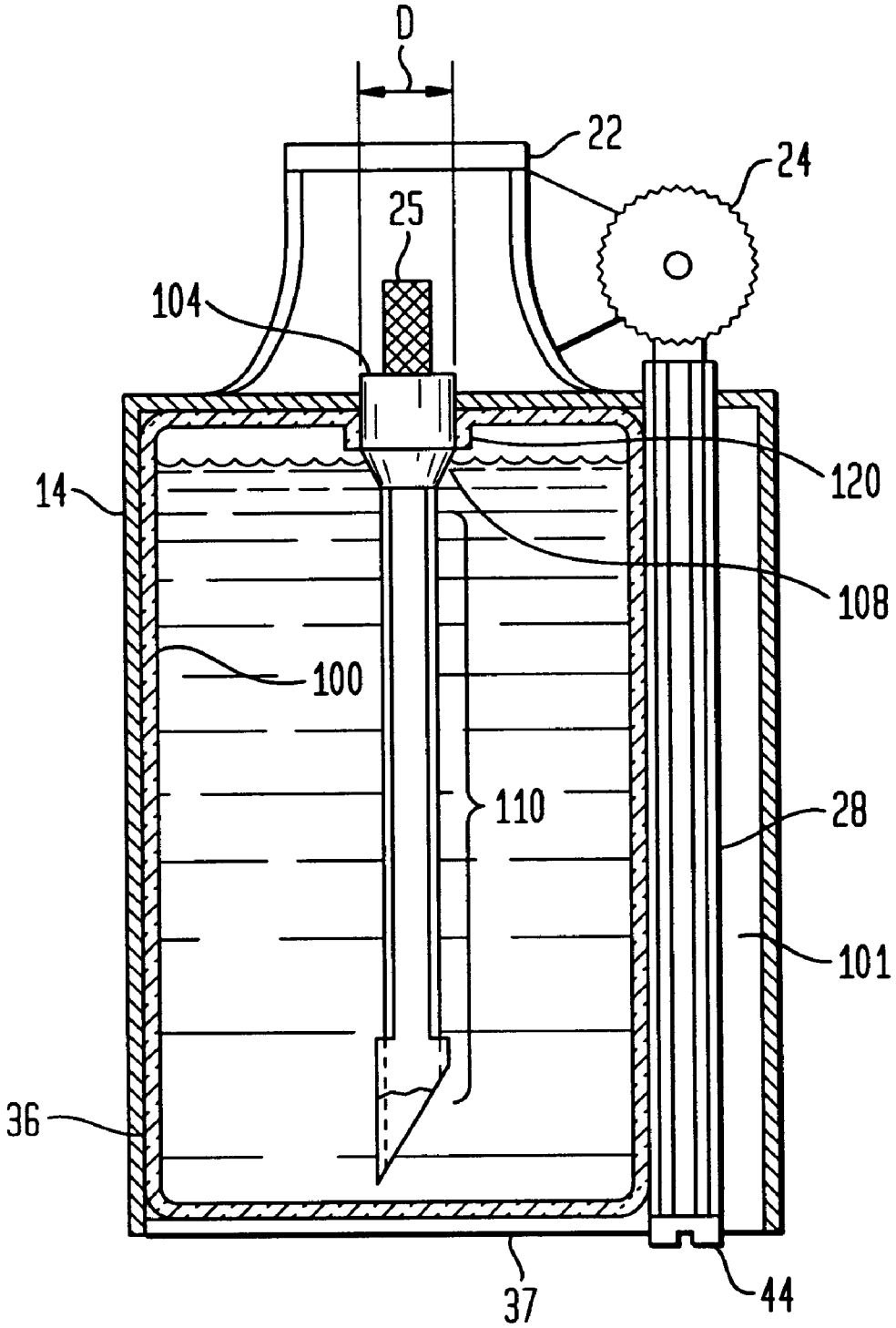
FIG. 7 illustrates the inside unit of the present invention, without the tang and corresponding resilient member on the exterior surface of the inside unit.

As shown in FIG. 6, the rigid wick tube 104 incorporates slots or perforations 106 along its sides to allow the fuel access the wick 25, which is contained in the tube 104. The wick tube 104 has a lip 108 near, and not at, the top of the wick tube 104. The lip 108, as shown in FIG. 7, has a perimeter D which is larger than (a) the bottom portion 110 of the wick tube 104, and (b) the opening size of Q to effect a seal with the rim 120 when the cell 100 is positioned in the inside unit 14. In other words, the lip 108 snaps in place under the rim 120. Once the fuel cell 100 is properly positioned, the wick 25 will absorb and transfer the fuel to its upper extremity for ignition.

Figure 8:
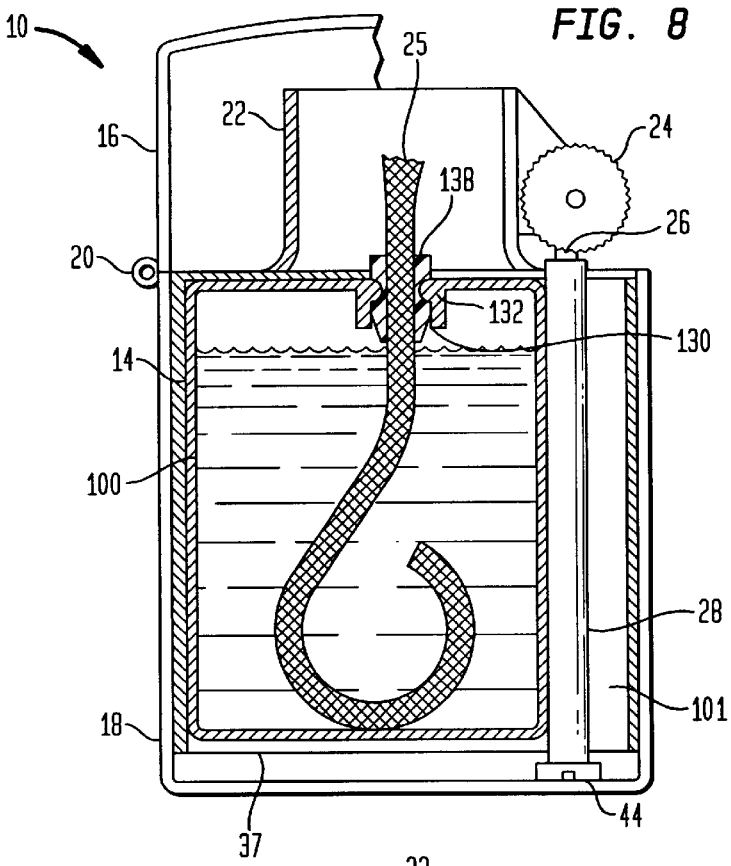
FIG. 8 illustrates an alternative embodiment of FIG. 7.

In an alternative embodiment that is shown in FIG. 8, the cell 100 has an aperture 130 with a neck 132 therein. The neck 132 is like an o-ring type seal. The neck 132 mates with the groove in a wick bushing 138 that holds the wick 25 in place. Once the aperture 130 exposed, the wick 25 will be fed into the aperture 130. The cell 100 is then snapped in place onto the wick bushing 138 as illustrated in FIG. 8.

Figure 9:
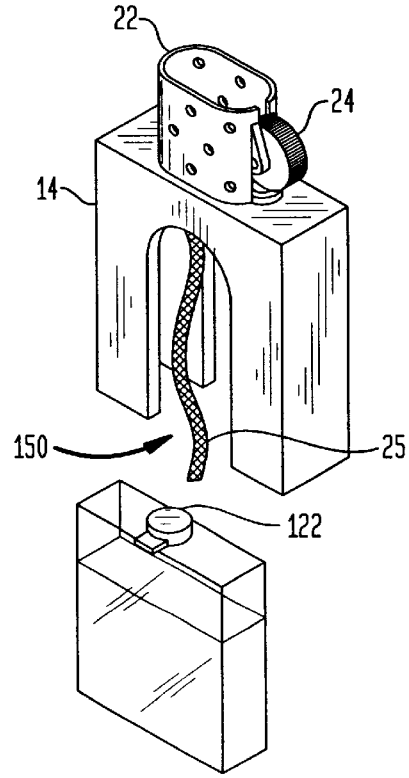
FIG. 9 illustrates an exploded view of an alternative embodiment of the invention.

As shown in FIG. 9, the inside unit 14 has at least one, and possibly two, openings 150 that allow a user to view the quantity of fuel in the cell 100 and allow the cell 100 to be easily removed therefrom. When the cell 100 is not being used in the lighter 10, the aperture 130 is covered by a snap-on cap, a seal, or a plug 122 (a removable seal), as shown in FIG. 9 or by a rupture disc as shown in FIG. 5.

Accordingly, this invention is directed to a remodeling of the inside unit 14 to avoid (1) overfilling the packing material which could lead to leakage of the lighter fuel, (2) inconsistency in the manner in which the packing material is inserted into the inside unit which creates variations of lighter fuel storage from one lighter to the next, and (3) underfilling the packing material to prevent leakage. In addition, the present invention will allow the user to know how much lighter fuel is in the lighter, easily carry extra lighter fuel, and maximize the amount of lighter fuel. The last item is an issue because in the reservoir the prior lighters use packing material and the packing material decreases the amount of fuel that can be stored in the inside unit.

Although variations in the embodiment of the present invention may not each realize all the advantages of the invention, certain features may become more important than others in various applications of the device. The invention, accordingly, should be understood to be limited only by the scope of the appended claims.

We claim:

1. A windproof lighter having an inside unit and a exterior case, the inside unit having side walls forming an interior chamber, a wick tube containing a wick, a flint, a flint position apparatus positioned in the interior chamber, a flint wheel, and a chimney, the inside unit having an opening disposed opposite the chimney, the lighter comprising:

a container having lighter fuel, and designed to fit within the interior chamber through the opening in the inside unit and not interfere with the flint position apparatus, the container further comprises an opening that receives the wick tube; and, the wick tube extends into the interior chamber and has a component that is larger than the opening so that when the container is properly positioned within the interior chamber, the component is disposed inside the container and secures the container to the inside unit and prevents accidental spillage of the lighter fuel.

2. The lighter of claim 1 wherein the opening is covered by a rupture disc that is opened by a the wick tube that contains a wick within the interior chamber.

3. The lighter of claim 2 wherein the wick tube has at least one aperture to allow the lighter fuel to contact the wick.

4. The lighter of claim 2 wherein the wick tube has a lip that mates with a rim on the opening.

5. The lighter of claim 1 wherein the opening is covered by a rupture disc.

6. The lighter of claim 1 wherein the container has a space to accommodate the flint position apparatus within the interior chamber.

7. The lighter of claim 1 wherein the inside unit has at least one aperture to view the quantity of lighter fuel in the container.

8. The lighter of claim 1 wherein the container before being inserted into the lighter has a removable seal thereon.

9. A windproof lighter having an inside unit and an exterior case, the inside unit having side walls forming an interior chamber, a wick bushing containing a wick, a flint, a flint position apparatus positioned in the interior chamber, a flint wheel, and a chimney, the inside unit having an opening disposed opposite the chimney, the lighter comprising:

a container having lighter fuel, and designed to fit within the interior chamber through the opening in the inside unit and not interfere with the flint position apparatus, the container further comprises an opening that receives the wick bushing, wherein the opening has a neck that mates with a the wick bushing that positions the wick in the lighter.

10. A method of refilling a windproof lighter having an inside unit and a exterior case, and the inside unit has an interior chamber, a wick tube containing a wick, a flint, a flint position apparatus positioned in the interior chamber, a flint wheel, and a chimney, comprising:

inserting a container having lighter fuel, designed to fit within the interior chamber and not interfere with the flint position apparatus, and an opening that receives the wick tube into the interior chamber;

positioning the wick tube through the opening; and, securing the container into the interior chamber to prevent accidental spillage of the lighter fuel, the container being secured to the interior chamber by engagement of a component on the wick tube with the opening, the component being larger than the opening and being disposed inside the container upon engagement.

11. The method of claim 10 wherein the opening is covered by a rupture disc that is opened by the wick tube that contains the wick within the interior chamber.

12. The method of claim 11 wherein the wick tube has at least one aperture to allow the lighter fuel to contact the wick.

13. The method of claim 11 wherein the wick tube has a lip that mates with a rib on the aperture.

14. The method of claim 10 wherein the container has a space to accommodate the flint position apparatus within the interior chamber.

15. The method of claim 10 wherein the inside unit has at least one aperture to view the quantity of lighter fuel in the container.

16. The method of claim 10 wherein the container before being inserted into the lighter has a removable seal thereon.

* * * * *

UNITED STATES PATENT AND TRADEMARK OFFICE

CERTIFICATE OF CORRECTION

PATENT NO. : 6,726,470 B1
DATED : April 27, 2004
INVENTOR(S) : Ronald J. Meister It is certified that error appears in the above-identified patent and that said Letters Patent is hereby corrected as shown below:

Column 3,
Line 44, “by a the wick” should read -- by the wick --; and

Column 4,
Line 6, “with a the wick” should read -- with the wick --.

Signed and Sealed this

First Day of February, 2005

JON W. DUDAS
*Director of the United States Patent and Trademark Office*